United States Patent [19]

Martens

[11] 4,296,889

[45] Oct. 27, 1981

[54] METHOD AND APPARATUS FOR WINDING TEXTILE YARNS

[75] Inventor: Gerhard Martens, Remscheid, Fed. Rep. of Germany

[73] Assignee: Barmag Barmer Maschinenfabrik Aktiengesellschaft, Fed. Rep. of Germany

[21] Appl. No.: 104,969

[22] Filed: Dec. 18, 1979

[30] Foreign Application Priority Data

Dec. 22, 1978 [DE] Fed. Rep. of Germany ..... 2855616

[51] Int. Cl.[3] ..... B65H 54/38

[52] U.S. Cl. ..... 242/18.1

[58] Field of Search ..... 242/18.1, 43 R

[56] References Cited

U.S. PATENT DOCUMENTS

| | | | |
|---|---|---|---|
| 2,763,824 | 9/1956 | Bacheler | 242/18.1 X |
| 3,235,191 | 2/1966 | Engelman | 242/18.1 |
| 3,241,779 | 3/1966 | Bray et al. | 242/18.1 |
| 3,402,898 | 9/1968 | Mattingly | 242/18.1 X |
| 3,514,682 | 5/1970 | Corey | 242/18.1 X |
| 3,638,872 | 2/1972 | Jennings | 242/18.1 |
| 3,799,463 | 3/1974 | Peckinpaugh | 242/18.1 |
| 3,910,514 | 10/1975 | Hooper | 242/18.1 |

FOREIGN PATENT DOCUMENTS

| | | | |
|---|---|---|---|
| 908794 | 10/1962 | United Kingdom | 242/18.1 |
| 1303630 | 1/1973 | United Kingdom | 242/18.1 |
| 1334852 | 10/1973 | United Kingdom | 242/18.1 |

*Primary Examiner*—Stanley N. Gilreath

[57] ABSTRACT

A method and apparatus for winding textile yarns into packages are provided in which the formation of undesirable patterns in the windings of yarn is completely avoided. According to this invention, any one of the variable parameters of traverse motion speed, such as time intervals between reversals from acceleration to deceleration or vice versa, traverse motion speed attained between such reversals or changes, or rates of acceleration or deceleration, is varied aperiodically, and the control of such speed changes may be accomplished digitally or analogically in response to a random number sequence.

40 Claims, 13 Drawing Figures

METHOD AND APPARATUS FOR WINDING TEXTILE YARNS

FIELD OF THE INVENTION

The present invention relates to the winding of textile yarns into core-supported packages and more particularly to a method and apparatus for winding textile yarns into such core-supported packages while avoiding the formation of undesirable patterns in the windings of yarn forming such packages.

BACKGROUND OF THE INVENTION

In the winding of textile yarns, it is well known to guide the yarns to rotating cores while traversing the yarn guides axially of the cores to form windings of the yarns about the cores. Such winding of textile yarns frequently results in a particularly acute problem which is referred to as "pattern formation." With increasing package diameter, this problem exists where the windings of yarn are superimposed on previously formed windings so as to directly overlie the same. Such pattern formation invariably occurs when the ratio of package revolutions per time unit (e.g. revolutions per minute) to the double stroke (a complete reciprocation, i.e. over and back) rate of the traversing yarn guide (e.g. reciprocations per minute) is equal to one or an integral multiple thereof.

Pattern formation in textile yarn packages results in trouble when unwinding the packages. Further, such patterns cause the winder to oscillate during formation of the packages and thus the drive rolls contact the packages unevenly which frequently results in slippage between the drive rolls and the packages causing damage to the packages. Therefore, pattern formation should be particularly avoided when processing smooth yarns, such as synthetic fibers or filaments.

Since pattern formation is known to occur when the ratio between package speed and traverse motion speed (or vice versa) is equal to an integer of a whole number other than zero, it has previously been proposed that either the package speed or traverse winder speed be changed in an attempt to ensure that such a ratio does not occur. It is particularly desirable to maintain the package speed as nearly constant as possible, particularly when processing synthetic fibers or filaments. Accordingly, previous attempts to avoid pattern formation have generally been directed toward changing the traverse motion speed or double stroke rate.

It is known to control the traverse motion of the yarn guide in such a manner that the aforementioned ratio does not result in an integer other than zero. This is accomplished by changing the traverse motion speed shortly before an integral ratio is reached. While effective, this previous attempt to solve this problem is not technically and economically feasible since a textile machine nearly always includes a multiplicity of winding positions, which have different package diameters at any given time. This means that, basically, the traverse motion speed can only be varied, in this previous proposal, with individually driven package positions and that, even then, each winding position must include package diameter sensor, a programmer and control device for changing the traverse motion speed.

It has also been proposed as an attempt to avoid or at least lessen the pattern formation to employ "wobbling" in the traverse motion speed or constant acceleration or deceleration between a minimum speed and a maximum speed (wobble range). Usually this wobble range varies from about ±1% to ±20% of the desired average traverse motion speed. However, this attempt does not effectively avoid pattern formation but only prolongs the time period within the winding cycle when pattern formation can be observed since the acceleration and deceleration occur periodically in accordance with a predetermined pattern (such as sine wave, sawtooth pattern, etc.). For example, the double stroke rate per minute on currently used winding machines ranges from several hundred to several thousand and it has been observed that a fourth degree pattern developed within a time interval of one minute without any pattern breaking means, whereas with wobbling means the same pattern was observed after a time interval of eight (8) minutes.

SUMMARY OF THE INVENTION

With the foregoing in mind, it is an object of this invention to provide a method and apparatus for winding textile yarns in which undesirable pattern formation is entirely avoided in an economically and technologically feasible manner. This object of the present invention is accomplished by constantly changing the traverse motion speed by continuously or continually accelerating and decelerating the yarn guide aperiodically.

It is a more particular object of this invention to provide a method and apparatus for winding textile yarns of the character described in which the yarn guide is constantly accelerated and decelerated and in which the switches from acceleration to deceleration or vice versa are varied aperiodically.

BRIEF DESCRIPTION OF THE DRAWINGS

Some of the objects of the invention having been stated, other objects will appear as the description proceeds, when taken in connection with the accompanying drawings, in which—

DETAILED DESCRIPTION OF THE INVENTION

Figure 10:
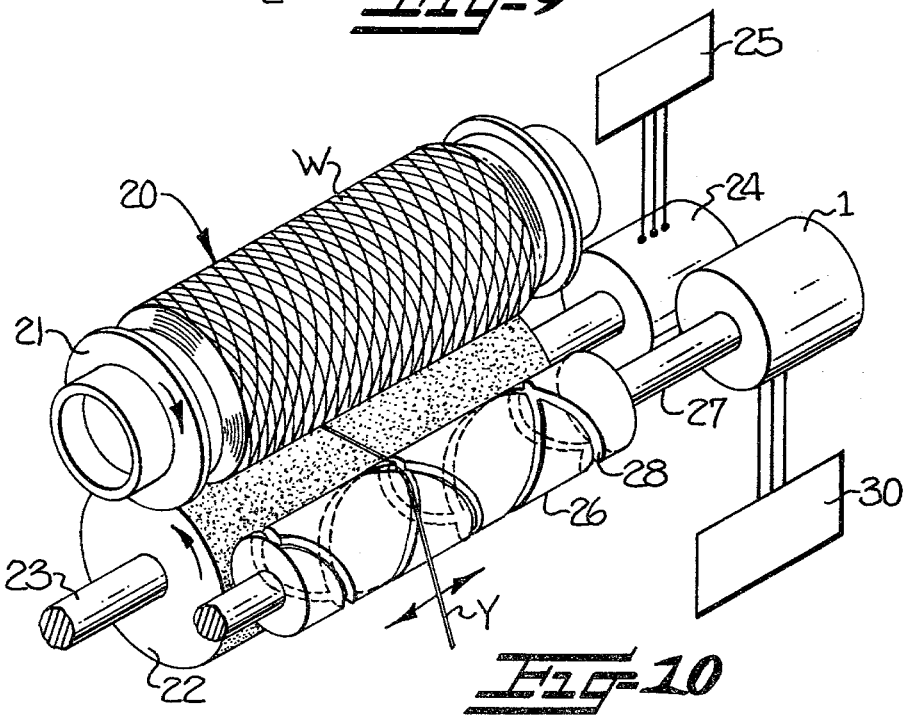
FIG. 10 is a somewhat schematic perspective view of a textile yarn winding apparatus for winding textile yarn in accordance with the method and apparatus of the present invention.

Referring now more particularly to the drawings and specifically to FIG. 10, there is illustrated therein a winding station for the winding of textile yarn into a core-supported package 20. While FIG. 10 illustrates a particular type of winding station, it should be understood that this invention is applicable to a wide range of textile yarn winding apparatus including commonly driven, multi-station winders and independently driven, single station winders.

As illustrated, package 20 includes a suitable core 21 about which windings W of the yarn Y are formed. Package 20 is surface driven by a drive roll 22 carried by a shaft 23. Shaft 23 is driven by a suitable drive means 24 which may be an electrical motor, gear transmission or the like. Drive means 24 is preferably controlled by a suitable control means 25 in known manner to wind the yarn about the core 21 at a substantially constant rate irrespective of the diameter of the package 20.

The textile yarn Y is guided onto the core 21 by a suitable yarn traverse guide 26 which is illustrated as a rotating member carried by a shaft 27 and having a yarn guide groove 28 in the surface thereof. Such yarn traverse guides are well known to persons skilled in the applicable textile arts. Obviously, a reciprocating yarn traverse guide could be used in lieu of the rotating guide 26 without departing from the scope of the present invention. Irrespective of which particular type of yarn traverse guide utilized, the yarn will be guided onto the core with a particular traverse motion speed, which is the rate or speed at which the yarn (or the traverse guide) is moved axially of the core 21. This traverse motion speed is sometimes referred to as "double stroke rate," which is the rate at which the yarn or guide makes one complete reciprocation (over and back) from one end of the core 21 or package 20.

Yarn traverse guide means 26 is suitably driven by a variable drive means 1, which may take any one of many different forms. For example, drive means 1 may be three-phase current drives, D.C. drives, infinitely variable gear transmissions, or hydraulic or pneumatic drives.

Irrespective of which particular drive means 1 is utilized, such traverse motion drive means is controlled by control means 30 to constantly change the traverse motion speed of the traverse yarn guide 26 so that the yarn guide 26 is constantly under acceleration or deceleration. While the traverse motion speed is constantly changed, such speed is kept within a predetermined range (herein referred to as the "wobble range") which corresponds to the range between the maximum permissible positive and negative variations or deviations from a predetermined average traverse motion speed.

Figure 1A:
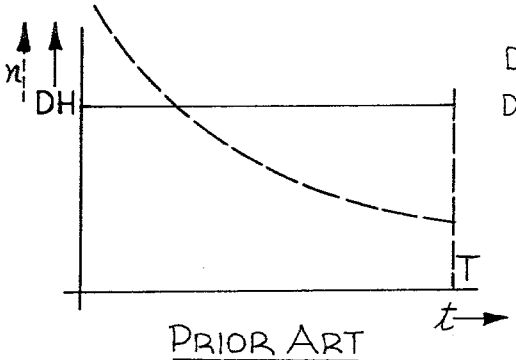
PRIOR ART Fig-1a
FIG. 1*a* is a graphic representation of yarn package speed and traverse motion speed of a conventional winding machine without any pattern breaking means.
Figure 1B:
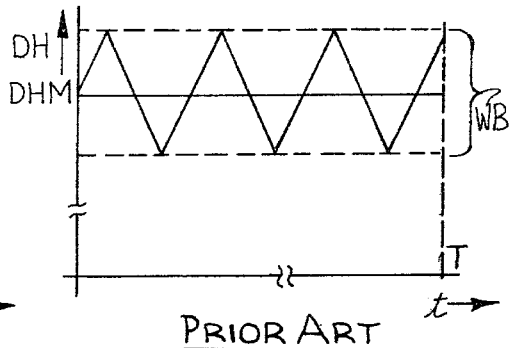
PRIOR ART Fig-1b
FIGS. 1*b*, 1*c* and 1*d* are all graphic representations of prior art textile yarn winding machines with pattern breaking means which constantly changes the traverse motion speed.
Figure 1C:
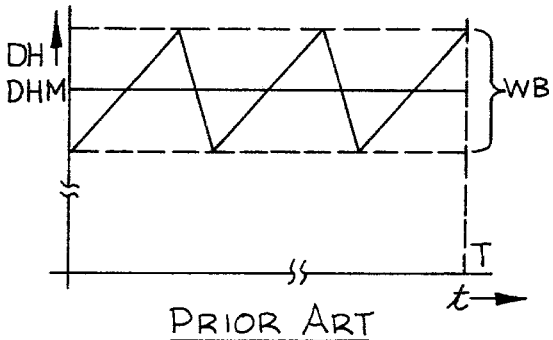
PRIOR ART Fig-1c
Figure 1D:
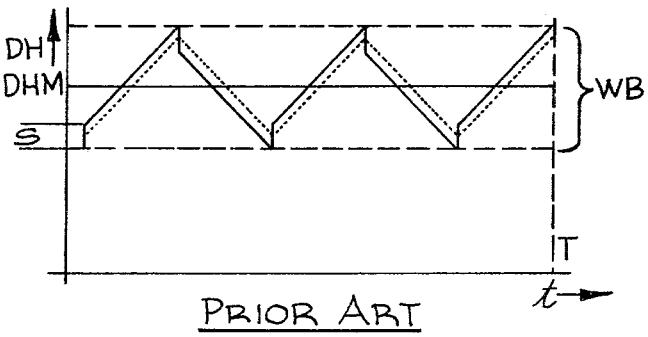
PRIOR ART Fig-1d

Referring now to FIG. 1*a*, there is graphically illustrated therein the relationship of package rotational speed and traverse motion speed. The vertical axis of the graph of FIG. 1*a* represents speed, with the arrow n indicating package rotational speed and the arrow DH indicating traverse motion speed (double stroke rate). The horizontal axis of the graph of FIG. 1*a* represents time, as is indicated by the arrow t, and the point T indicates the full extent or elapsed time period of a winding cycle in which a completed package 20 has been formed. The interrupted line in FIG. 1*a* represents the decreasing rotational speed n of a winding package driven on its circumference at a constant speed. The solid, straight line DH represents a constant double stroke rate, i.e. no attempt is made to avoid the formation of a pattern in the windings of the package being formed. FIGS. 1*b*, 1*c* and 1*d* are illustrative of previous attempts to provide some pattern breaking and, in each instance, the average double stroke rate DHM has superimposed thereon a speed change within the wobble range WB. in FIG. 1*b*, the traverse motion speed or double stroke rate is constantly changed by acceleration and deceleration at the same, constant rate and with switching from acceleration to deceleration or vice versa occurring only at the respective limits of the wobble range WB. In FIG. 1*c*, an arrangement similar to that illustrated in FIG. 1*b* is shown except that the rate of acceleration is less than the rate of deceleration. This gives a sawtooth shape to the graphic representation of traverse motion speed as opposed to the generally sine wave representation of FIG. 1*b*. In FIG. 1*d*, the whole signal for acceleration and deceleration (like in FIG. 1*b*) has superimposed thereon a constant rectangular signal of the same direction. With the use of an asynchronous motor to drive the traverse motion means, traverse motion speed advantageously changes with a relatively sharp "kink" at the reversal point. Preferably, the magnitude S (FIG. 1*d*) of this kink in the traverse motion speed equals approximately the sum of positive and negative slips encountered with the use of an asynchronous motor. It should be mentioned that all of the pattern breaking methods illustrated graphically in FIGS. 1*b*, 1*c* and 1*d* have been proposed prior to this invention, and have not proven to be successful solutions to the problem of pattern formation, and have still experienced pattern formation. The present invention, on the other hand, has proven that no pattern formations were to be seen by stroboscopic observations, by oscillation measurements, or by testing the unwinding properties of the yarn package.

Figure 2:
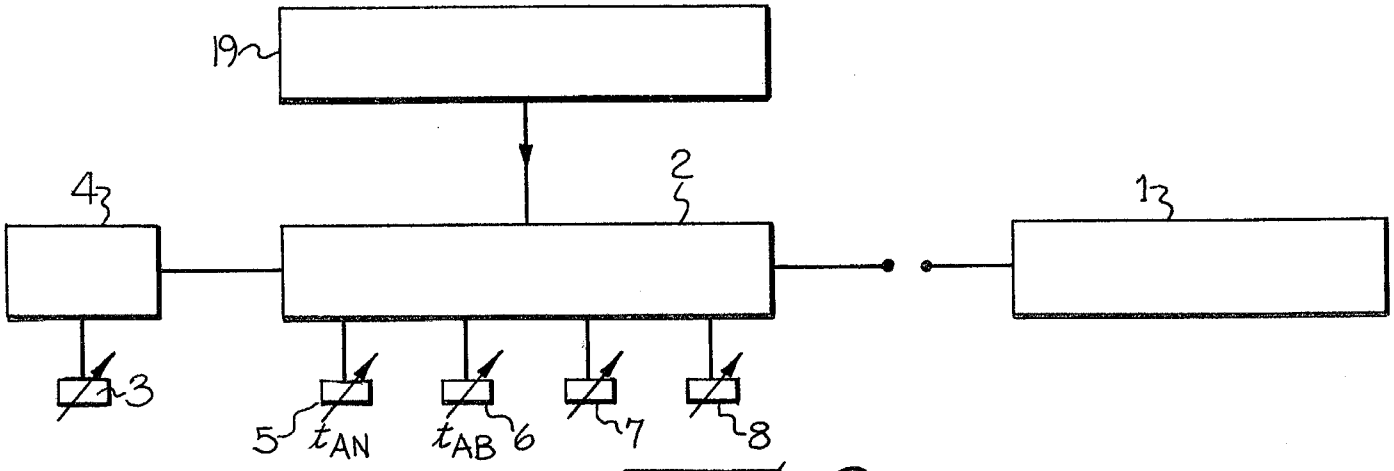
FIG. 2 is a schematic view illustrating an apparatus for controlling a textile winding machine in accordance with the present invention.

In accordance with the present invention, any one of the previously proposed pattern breaking methods of traverse motion speed change may be employed with suitable modification to provide that the changes in traverse motion speed occur aperiodically. FIG. 2 illustrates a wiring diagram for control means 30 which controls traverse drive means 1 in accordance with this invention. Control means 30 includes modulation means 2 connected to drive means 1 and which modifies the control value of the drive speed for wobbling purposes. With the use of a three-phase motor, for example, the control value of drive speed would be frequently, which is preset by setpoint input 3 and speed input 4. In this arrangement, setpoint input 5 sets the acceleration time, setpoint input 6 sets the deceleration time, setpoint input 7 the jump height or kink magnitude S (FIG. 1*d*), if such is desired, and setpoint input 8 determines or controls the wobble range WB, i.e. the maximum and minimum values are set by these inputs. According to this invention, a random signal input 19 also acts upon modulation means 2 and may be used to affect any one of the variable parameters of traverse motion speed, such as time intervals between changes, rate of acceleration and deceleration, and/or traverse motion speed attained between changes.

Random signal input 19 may be any one of a variety of signal generators capable of producing a random sequence, which will readily occur to one skilled in the applicable arts. For example, a radioactive receiver with the coordinated counter of the type disclosed in German Patent No. 959,447 may be used. Further, another random number generator which may be used is described in *Elektronik Industrie* 1978, page 24. Since it is not necessary for the random sequence to be maintained for an unlimited period of time, or even for the entire winding cycle but only for continuously successive sections of the winding cycle, pseudo-random generators, which are available as electronic components (such as feedback shifting registers described in Siemens *Schaltbeispiele* 1977/78, pages 56–58 and in an article by Leonard H. Anderson in *Electronics* of Nov. 9, 1978, page 134ff), may also be used. Alternatively, for advantageous simplification, random number sequences or pseudo-random number sequences may be stored and called up by a programmer.

Figure 3:
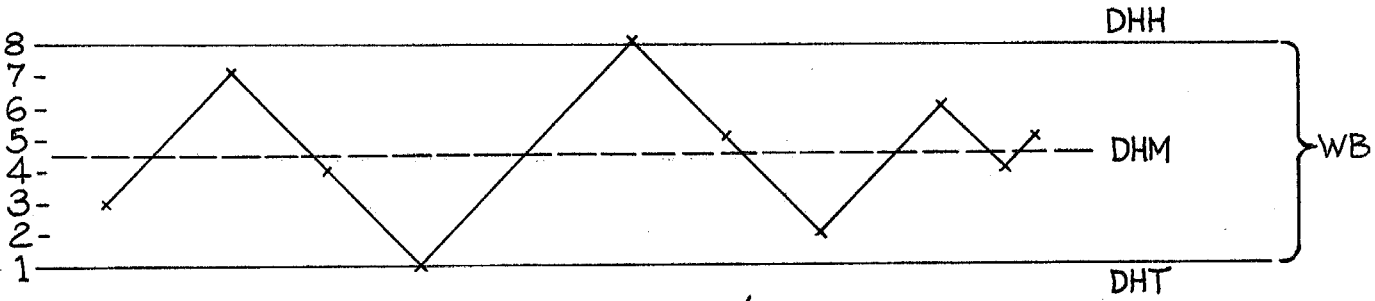
FIG. 3 is a schematic graphic illustration of traverse motion speed being changed aperiodically in accordance with the present invention.

FIG. 3 illustrates a method according to the present invention in which the traverse motion speed attained between changes is controlled in accordance with a random sequence (double stroke rate with randomly controlled amplitude). As illustrated, the wobble range WB has a minimum traverse motion speed DHT, a maximum traverse motion speed DHH and an average traverse motion speed DHM. The wobble range is divided into increments or steps 1 to k representing different traverse motion speeds, and, in FIG. 3, these increments or steps are numbered 1 to 8 with the number 1 corresponding to the lowest value DHT of traverse motion speed and the number 8 corresponding to the highest value DHH thereof. These increments or steps are called up in a random number sequence, as determined by the random signal input means 19 of FIG. 2.

The random number sequence illustrated is 3, 7, 4, 1, 8, 5, 2, 6, 4, 5, . . . with each number representing a target traverse motion speed which the drive means 1 is controlled to attain before another target speed is determined. Starting at the left in FIG. 3, the traverse yarn guide 26 is being driven at a double stroke rate corresponding to the number 3 and the drive means 1 is in the acceleration mode. The random signal input means 19 indicates to modulation means 2 that the next target speed is that corresponding to the number 7—whereupon the drive means 1 is controlled to accelerate (at a constant rate in the illustrated embodiment) until that traverse motion speed is attained. Since the next target speed is that corresponding to the number 4, the modulation means 2 switches or changes drive means 1 to the deceleration mode and the traverse motion speed is decreased (also at a constant rate in this embodiment and at the same rate as the acceleration) until the traverse motion speed corresponding to the number 4 is reached. The next number in the sequence is 1 and therefore modulation means 2 maintains drive means 1 in the deceleration mode until this still lower traverse motion speed is attained. The sequence then continues throughout the entire winding cycle or the portion thereof to which the random number sequence corresponds.

Figure 4:
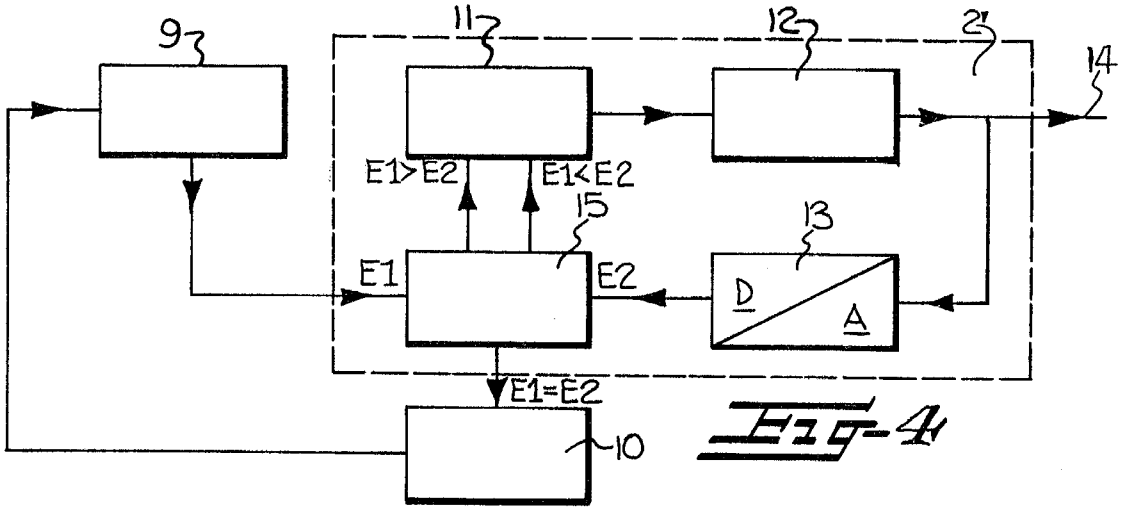
FIG. 4 is a modified form of control means for controlling a textile yarn winding machine in accordance with the present invention.

In FIG. 4, there is illustrated, a somewhat different embodiment of control circuit according to the present invention in which modulation means 2' accommodates an inlet for the output signal $E_1$ of a memory 9 which stores a random number sequence. The memory address for the respective random number value is determined by the output signal of a counter 10. Modulation means 2' consists of a switch 11 which is operative between a negative output signal for deceleration and a positive output signal for acceleration. The output signal from the switch 11 is fed to an integrator 12, which supplies a time-proportionally increasing or decreasing output signal. This output signal (indicated at 14) is added to the signal for the basic drive speed and serves as an input signal for the regulation or control of drive means 1. Signal 14, representing the wobble signal, is fed as signal $E_2$, by way of analog-digital converter 13, to comparator 15. Comparator 15 compares the random number value $E_1$ with the digitized value of wobble signal $E_2$. If the random signal $E_1$ from the memory 9 is larger than wobble signal $E_2$, switch 11 reverses or changes to acceleration. If the wobble signal $E_2$ is or becomes larger than the random signal $E_1$, switch 11 reverses or changes to deceleration. Another outlet of the comparator 15 makes the counter 10 move by one step, if the signals $E_1$ and $E_2$ are equal or the same.

Figure 5:
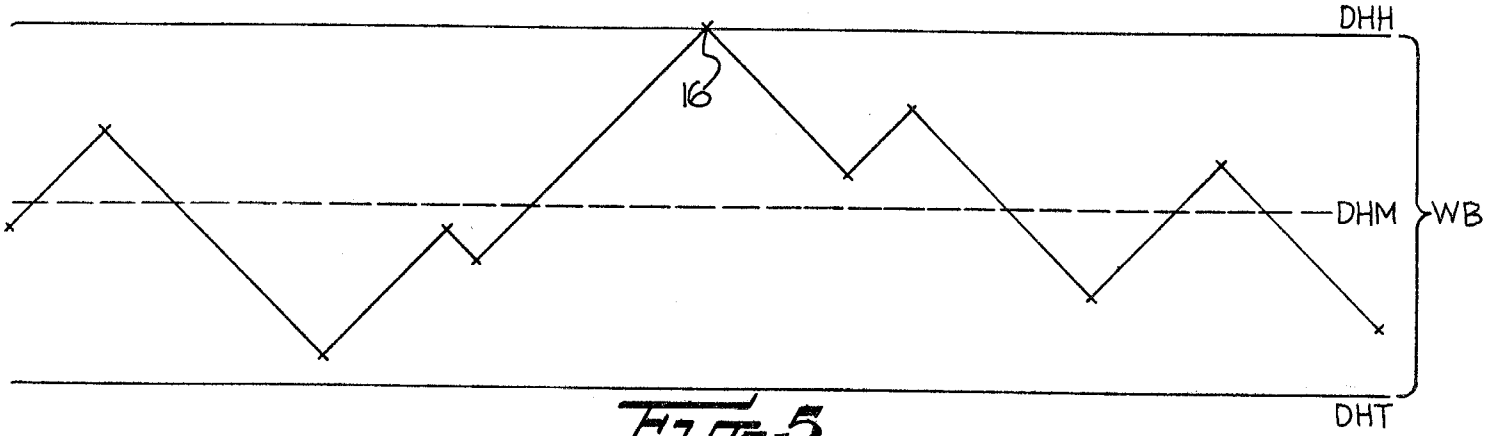
FIG. 5 is a schematic graphic representation of traverse motion speed being changed aperiodically in accordance with another embodiment of the method and apparatus of the present invention.

As stated previously, any one of the variable parameters of traverse motion speed may be varied aperiodically and FIG. 3 illustrated the variance of attained traverse motion speed in response to the random number sequence. FIG. 5 illustrates an embodiment of the present invention in which the time intervals between reversals or switchings from acceleration to deceleration or vice versa are varied aperiodically. A preset or predetermined maximum time (the winding cycle or a particular portion thereof) is divided into a specific number of intervals, steps or units 1 to k. The illustrated example has the time intervals numbered 1 to 8, and again, the random number sequence is 3, 7, 4, 1, 8, 5, 2, 6, 4, 5. This results in an aperiodic curve of the traverse motion speed in which the drive means 1 is in the acceleration mode for three (3) time intervals or units and is then switched to the deceleration mode for seven (7) time intervals or units. Then, the drive unit 1 is switched back to the acceleration mode for four (4) time units; switched to the deceleration mode for one (1) time unit; and then switched back to the acceleration mode for what is supposed to be eight (8) time units. However, if drive means 1 accelerates for eight (8) time units, the traverse motion speed will exceed the maximum permissible traverse motion speed DHH and therefore, when the traverse motion speed reaches point 16, drive means 1 is prematurely switched to deceleration and the remainder of the eight (8) time units are suppressed. Such deceleration continues for the five (5) time units in accordance with the next number in the random sequence, and so on through the remainder of the winding cycle.

Figure 6:
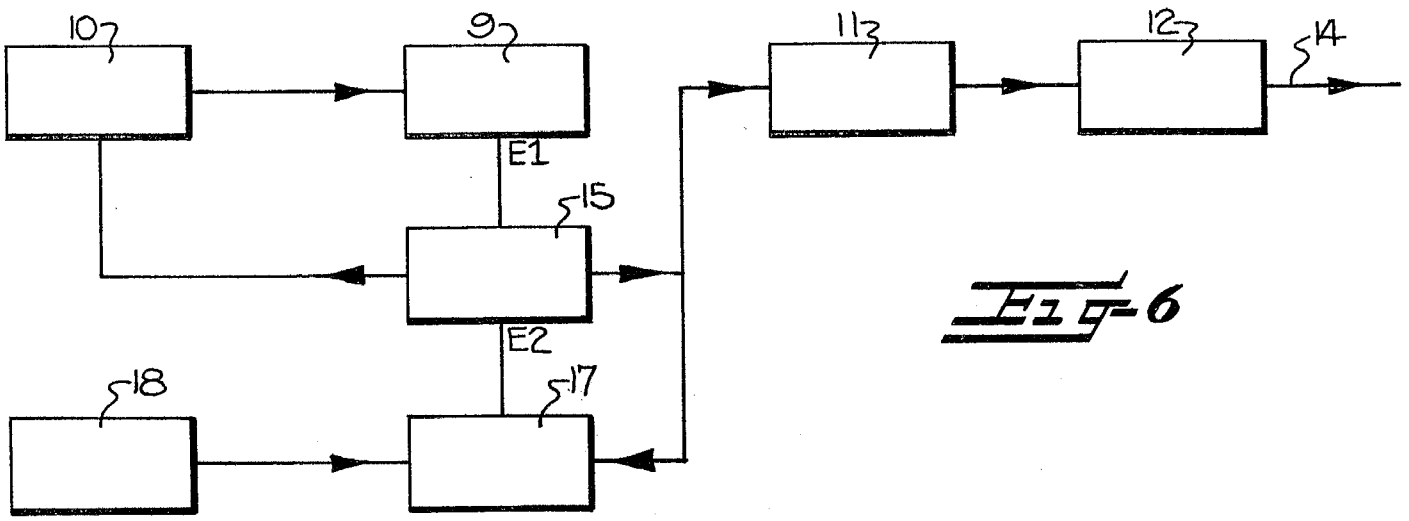
FIG. 6 is a schematic view of another form of control means for controlling a textile yarn winding apparatus in accordance with the present invention.

In FIG. 6, there is shown a modified form of control means which includes the memory 9, counter 10, switch 11, integrator 12 and comparator 15 like the control means shown in FIG. 4 and also a counter 17 and impulse generator 18. As before, a random number sequence (signal $E_1$) is issued by the memory 9 and the counter 10, and the switch 11 and integrator 12 supply the wobble signal 14. The reversals or switches from acceleration to deceleration or vice versa is then effected by the comparator 15, which simultaneously sets the counter 17 to zero. The counter 17, which is connected to the impulse generator 18, integrates the time intervals, steps or units to one entire time, which equals the numerical value $E_2$. If the value $E_2$ is the same as or larger than the preset random number value $E_1$, switch 11 reverses to change or switch modes, counter 17 resets, and counter 10 moves to the next step.

Figure 7:
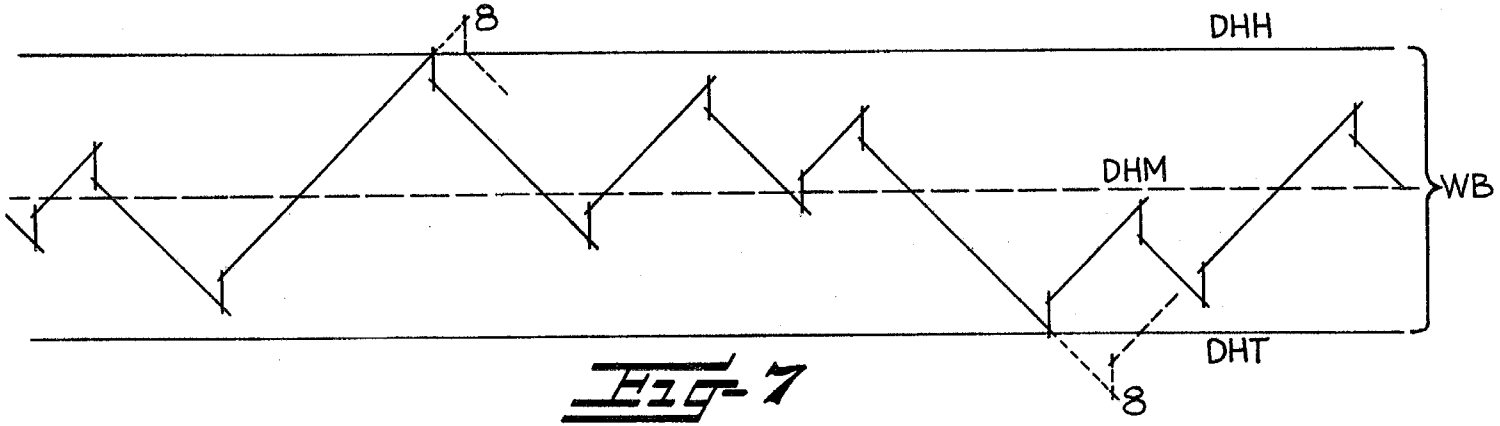
FIG. 7 is a schematic graphic illustration of traverse motion speed being changed aperiodically in accordance with a further embodiment of the method and apparatus of the present invention.

In FIG. 7, there is illustrated graphically a method in which the time intervals between switches from acceleration to deceleration or vice versa are changed aperiodically with the superimposition of a rectangular signal of the same direction. The changeover or reversal time is again divided into the time units or intervals 1 to 8 and, as illustrated, the random number sequence is 2, 4, 8, 5, 4, 3, 2, 8, 3, 2, 5 . . . . As with previous illustrations, the rate of acceleration and deceleration is constant and the same. At each reversal point, the constant rectangular signal for acceleration or deceleration, respectively, forms a sharp "kink" in the traverse motion speed curve. Also, as previously described, the randomly set time interval 8 if permitted to control would cause the traverse motion speed to exceed the maximum permissible speed in one instance, and to fall below the minimum speed in the other instance. Therefore, the drive unit 1 is controlled to switch from acceleration to deceleration or vice versa when the speeds DHH and DHT are reached and the random set time intervals are suppressed.

Figure 8:
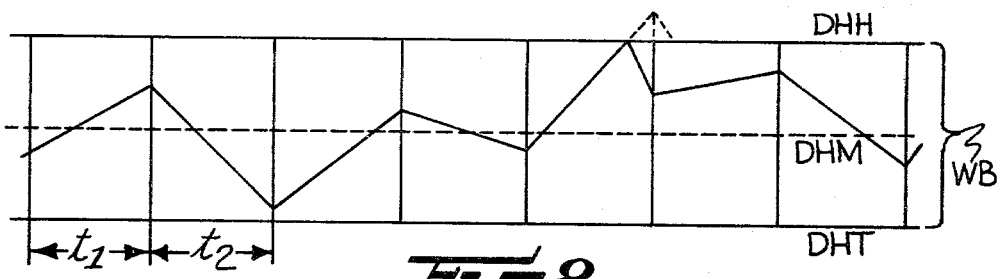
FIG. 8 is a schematic graphic illustration of traverse motion speed being changed aperiodically in accordance with another embodiment of the present invention.

In each of the illustrations described to this point, the rate of acceleration and deceleration have remained constant and identical and it has been other parameters that have been varied. In FIG. 8, there is illustrated an embodiment in which the time intervals $t_1$, $t_2$, etc. are maintained constant and the rates of acceleration and deceleration are varied aperiodically. The reversals or switches from acceleration to deceleration or vice versa occur at the end of each time interval. However, if the random number sequence sets a rate of acceleration or deceleration which would cause the traverse motion speed to move outside of the wobble range, the switchover from acceleration to deceleration or vice versa occurs once the speed equals the limits of the wobble range and the rate of the next acceleration or deceleration mode is determined by the next number in the sequence and reversal occurs at the end of the time interval.

Figure 9:
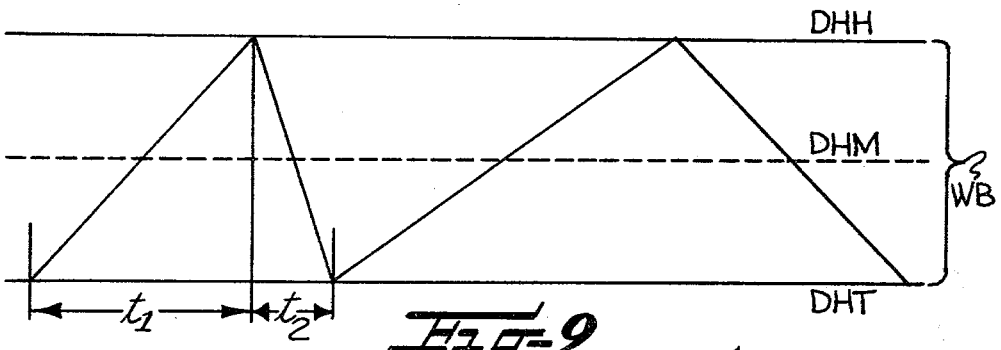
FIG. 9 is a graphic schematic illustration of traverse motion speed being varied aperiodically in accordance with a modified form of the method and apparatus of the present invention.

In FIG. 9, there is illustrated an embodiment in which switches from acceleration to deceleration or vice versa occur only when the traverse motion speed reaches the limits of the wobble range and the rates of acceleration and deceleration are varied aperiodically. Of course, the time intervals $t_1$, $t_2$, etc. will also vary aperiodically.

It should be emphasized that, for ease of illustration, the curves shown in FIGS. 3, 5, 7, 8 and 9 show the reversals or switches from acceleration to deceleration or vice versa as a sharp point or instantaneous occurrence. While such reversals or switches are desirable, they are technically difficult to obtain due to unavoidable delays and idle times (due to forces of inertia, etc.). According to this invention, it is unnecessary that the reversals or switch-overs from acceleration to deceleration or vice versa occur instantaneously since such reversals are not particularly critical. It has been shown that a steady reversal or switch-over of the traverse motion speed curve has no damaging effects.

It should also be noted that the linear increase or decrease of the traverse motion speed, i.e. constant acceleration or deceleration, between the individual reversal points is not always obtainable or desirable. Thus, for example, the traverse motion speed will increase or decrease in the form of an E-function, if the traverse motion speed is controlled as a function of a condenser charge. Therefore, this invention also relates to controls for the traverse motion speed in which the traverse motion speed curve is not a straight line.

In the drawings and specification there have been set forth preferred embodiments of the invention, and although specific terms are employed they are used in a generic and descriptive sense only and not for purposes of limitation.

What is claimed is:

1. In a method of winding textile yarns into core-supported packages in which the yarn is wound about the core at a substantially constant rate while the yarn is guided onto the core by a traversing yarn guide and in which the traverse motion speed of the yarn guide is continually changed by accelerating and decelerating the traverse motion of the yarn guide, the improvement therein comprising changing aperiodically the traverse motion speed of the yarn guide by varying aperiodically at least one of the time intervals between switching from acceleration to deceleration or vice versa, the rate of acceleration and/or deceleration and the traverse motion speed attained between switching from acceleration to deceleration or vice versa to prevent undesirable pattern formation in the yarn windings in the package formed thereby.

2. A method according to claim 1 wherein the aperiodical changes in traverse motion speed are made by controlling the acceleration and deceleration of the traversing yarn guide in response to the generation of a random sequence of at least one of the variable parameters of traverse motion speed, such as time interval between changes, traverse motion speed attained between changes, and rate of change of traverse motion speed.

3. A method according to claim 2 wherein at least one of the variable parameters of traverse motion speed is changed digitally or in steps.

4. A method according to claim 2 wherein at least one of the variable parameters of traverse motion speed is changed analogically or continuously.

5. In a method of winding textile yarns into core-supported packages in which the yarn is wound about the core at a substantially constant rate while the yarn is guided onto the core by a traversing yarn guide and in which the traverse motion speed of the yarn guide is continually changed by accelerating and decelerating the traverse motion of the yarn guide, the improvement therein comprising changing aperiodically the traverse motion speed of the yarn guide by switching from acceleration to deceleration or vice versa while varying aperiodically the time intervals between such switching so that undesirable pattern formation in the yarn windings in the package formed thereby is prevented.

6. A method according to claim 5 wherein the time intervals between the switches from acceleration to deceleration or vice versa are varied in response to a random sequence.

7. A method according to claim 6 wherein the time intervals between the switches from acceleration to deceleration or vice versa are varied by dividing a predetermined time period into increments or steps 1 to k, and wherein the random sequence is of the numbers 1 to k.

8. A method according to claim 7 wherein the changes in traverse motion speed are limited to a predetermined wobble range defined by the maximum permissible positive and negative deviations from a predetermined average traverse motion speed.

9. A method according to claim 8 wherein a switch from acceleration to deceleration or vice versa is made when the traverse motion speed reaches the limits of said predetermined wobble range irrespective of whether or not the random number sequence would dictate a switch at that time.

10. A method according to claim 8 wherein all of the switches from acceleration to deceleration or vice versa occur when the traverse motion speed reaches the limits of said wobble range.

11. A method according to any of claims 5–9 wherein the traverse motion speed attained between the switches from acceleration to deceleration or vice versa also varies aperiodically.

12. A method according to any of claims 7–10 wherein said predetermined time period comprises the winding cycle time period required to form a completed yarn package so that said random number sequence embraces the entire winding cycle.

13. A method according to any of claims 5–9 wherein the acceleration and deceleration of the traverse motion speed is controlled by a time-proportional analog control signal, and including superimposing a rectangular signal of the same direction upon the time-proportional analog signal at each switching from acceleration to deceleration or vice versa.

14. A method according to claim 13 wherein the magnitude of the superimposed rectangular signal is approximately equal to the sum of positive and negative slips encountered in the use of asynchronous motors.

15. In a method of winding textile yarns into core-supported packages in which the yarn is wound about the core at a substantially constant rate while the yarn is guided onto the core by a traversing yarn guide and in which the traverse motion speed of the yarn guide is continually changed by accelerating and decelerating the traverse motion of the yarn guide, the improvement therein comprising changing aperiodically the traverse motion speed of the yarn guide by switching from acceleration to deceleration or vice versa whie varying aperiodically the traverse motion speed attained between such switching so that undesirable pattern formation in the yarn windings in the package formed thereby is prevented.

16. A method according to claim 15 wherein the traverse motion speed attained between the switches from acceleration to deceleration or vice versa is varied in response to a random sequence.

17. A method according to claim 15 wherein the changes in traverse motion speed are limited to a predetermined wobble range defined by the maximum permissible positive and negative deviations from a predetermined average traverse motion speed.

18. A method according to claim 17 wherein the traverse motion speed attained between the switches from acceleration to deceleration or vice versa is varied by dividing said wobble range into a predetermined number of increments or steps 1 to k representing different traverse motion speeds, and wherein said random sequence is of the numbers 1 to k.

19. A method according to claim 18 wherein the time intervals between the switches from acceleration to deceleration or vice versa also vary aperiodically.

20. In a method of winding textile yarns into core-supported packages in which the yarn is wound about the core at a substantially constant rate while the yarn is guided onto the core by a traversing yarn guide and in which the traverse motion speed of the yarn guide is continually changed by accelerating and decelerating the traverse motion of the yarn guide, the improvement therein comprising changing aperiodically the traverse motion speed of the yarn guide by switching from acceleration to deceleration or vice versa while varying aperiodically the rate of acceleration and/or deceleration between such switching so that undesirable pattern formation in the yarn windings in the package formed thereby is prevented.

21. A method according to claim 20 wherein the rate of acceleration and/or deceleration between said switching is varied in response to a random sequence.

22. A method according to claim 20 wherein the time intervals between the switches from acceleration to deceleration or vice versa are constant while the traverse motion speed attained between such switches varies aperiodically.

23. A method according to any of claims 20–22 wherein the changes in traverse motion speed are limited to a predetermined wobble range defined by the maximum permissible positive and negative deviations from a predetermined average traverse motion speed.

24. A method according to claim 23 wherein a switch from acceleration to deceleration or vice versa is made when the traverse motion speed reaches the limits of said predetermined wobble range irrespective of whether or not the random number sequence would dictate a switch at that time.

25. A method according to claim 20 wherein the traverse motion speed attained between the switches from acceleration to deceleration remains constant while the time intervals between such switches vary aperiodically, 26. A method according to claim 25 wherein the traverse motion speed attained between said switches corresponds to the limits of a predetermined wobble range defined by the maximum permissible positive and negative deviations from a predetermined average traverse motion speed.

27. In an apparatus for winding textile yarns into core-supported packages including means for rotating the core to wind the yarn therearound at a substantially constant rate, yarn guide means movable axially of the core for guiding the yarn onto the core, and means for traversing said yarn guide means at a continually changing traverse motion speed, the improvement therein comprising control means operably connected to said traversing means for controllably continuously accelerating and decelerating said yarn guide aperiodically to prevent undesirable pattern formation in the yarn windings forming the package.

28. Apparatus according to claim 27 wherein the changes in traverse motion speed have variable parameters including time interval between switchings from acceleration to deceleration or vice versa, maximum or minimum traverse speed attained between such switchings, and rate of acceleration or deceleration of said yarn guide, and wherein said control means includes means for generating a random sequence of at least one of said variable parameters and means for controlling the acceleration and deceleration of said yarn guide in response to said random sequence.

29. Apparatus according to claim 28 wherein said random sequence generating means determines said random sequence digitally or in steps.

30. Apparatus according to claim 28 wherein said random sequence generating means determines said random sequence analogically or continuously.

31. Apparatus according to claim 28 wherein said random sequence generating means generates a random sequence of the time intervals between switchings from acceleration to deceleration or vice versa.

32. Apparatus according to claim 31 wherein said random sequence generating means generates the random sequence of time intervals by dividing a predetermined time period corresponding to at least a substantial portion of the cycle time required to form a completed package into increments or steps 1 to k and by generating a random sequence of the numbers 1 to k.

33. Apparatus according to claim 32 wherein said control means includes means limiting the changes in traverse motion speed to a predetermined wobble range defined by the maximum permissible positive and negative deviations from a predetermined average traverse motion speed.

34. Apparatus according to claim 28 wherein said random sequence generating means generates a random sequence of the maximum or minimum traverse motion speed attained between switchings from acceleration to deceleration or vice versa.

35. Apparatus according to claim 34 wherein said control means includes means limiting the changes in traverse motion speed to a predetermined wobble range defined by the maximum permissible positive and negative deviations from a predetermined average traverse motion speed.

36. Apparatus according to claim 35 wherein said random sequence generating means generates the random sequence of maximum or minimum attained traverse motion speed by dividing said wobble range into a predetermined number of increments or steps 1 to k representing different traverse motion speed and by generating a random sequence of the numbers 1 to k.

37. Apparatus according to claim 28 wherein said random sequence generating means generates a random sequence of the rate of acceleration or deceleration of the yarn guide.

38. Apparatus according to claim 37 wherein said control means includes means limiting the changes in traverse motion speed to a predetermined wobble range defined by the maximum permissible positive and negative deviations from a predetermined average traverse motion speed.

39. Apparatus according to claim 38 wherein said control means also varies aperiodically the maximum or minimum traverse motion speed attained between switchings from acceleration to deceleration or vice versa.

40. Apparatus according to claim 38 wherein said control means also varies aperiodically the time intervals between switchings from acceleration to deceleration or vice versa.

* * * * *

UNITED STATES PATENT AND TRADEMARK OFFICE

CERTIFICATE OF CORRECTION

PATENT NO. : 4,296,889

DATED : October 27, 1981

INVENTOR(S) : Gerhard Martens

It is certified that error appears in the above-identified patent and that said Letters Patent are hereby corrected as shown below:

Column 2, line 25, after "constantly" insert --or continually--;
Column 2, line 26, delete "or continually";
Column 4, line 31, "whole" should be --wobble--;
Column 4, line 62, "frequently" should be --frequency--;
Column 6, line 3, after "illustrated" omit the comma (,);
Column 9, line 45, "whie" should be --while--.

Signed and Sealed this

*Fifth* Day of *July 1983*

[SEAL]

*Attest:*

GERALD J. MOSSINGHOFF

*Attesting Officer*

*Commissioner of Patents and Trademarks*